United States Patent [19]

Grahn

[11] 4,117,679

[45] Oct. 3, 1978

[54] HOT GAS ENGINE HEATER HEAD

[75] Inventor: Per Göran Grahn, Lund, Sweden

[73] Assignee: Kommanditbolaget United Stirling (Sweden) AB & Co., Malmo, Sweden

[21] Appl. No.: 773,798

[22] Filed: Mar. 2, 1977

[51] Int. Cl.[2] ..... F02G 1/04
[52] U.S. Cl. ..... 60/525
[58] Field of Search ..... 60/517, 524, 525, 526

[56] References Cited

U.S. PATENT DOCUMENTS

| | | | |
|---|---|---|---|
| 3,802,198 | 4/1974 | Grossman | 60/525 |
| 3,863,452 | 2/1975 | Asselman | 60/524 |
| 3,890,785 | 6/1975 | Torsten | 60/525 |

*Primary Examiner*—Allen M. Ostrager
*Attorney, Agent, or Firm*—Laurence R. Brown

[57] ABSTRACT

A heater head is arranged about the central axis of a multiple cylinder hot gas turbine with a manifold ring of a diameter substantially smaller than the combustion chamber and connected to cylinders and regenerators by heat exchanger tubes extending upwardly therefrom and inwardly toward the manifold.

4 Claims, 6 Drawing Figures

HOT GAS ENGINE HEATER HEAD

Figure 1:
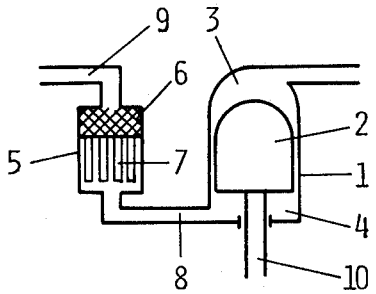

This invention relates to a hot gas engine heater head of the kind (herein called "the kind defined") comprising at least one combustion chamber and a plurality of cylinders and regenerators arranged around a central axis of said combustion chamber, heat exchanger tubes connected to each cylinder top and other heat exchanger tubes connected to each regenerator top, all of said tubes also being connected to manifolds extending horizontally above said cylinders and regenerators, and said manifolds being shaped as annular segments which together form a ring above the cylinder and regenerator tops.

BACKGROUND

In a heater head of the kind defined it has been common practice to form the said ring of a diameter corresponding to or greater than the horizontal extent of the combustion chamber. In hot gas engines the non-variable spaces containing working gas i.e. the spaces not limited by the pistons and the cylinder walls, should be kept as small as possible. Also the surfaces exposed to heat by radiation from the combustion chamber should be as large as possible, whereas the resistance against the gas flow inside the heat exchanger tubes should be as small as possible. Modifications of design to achieve advantages of one kind nearly always cause disadvantages in other respects, and therefore it is an object of the present invention to provide a heater head of the kind defined which can be constructed to give good efficiency without involving severe disadvantages, for example in respect of cost.

BRIEF DESCRIPTION OF THE INVENTION

According to the present invention a heater head of the kind defined is characterised in that the said heat exchanger tubes extend upwardly and inwardly towards the said central axis relative to said cylinder and regenerator tops, and that the ring formed by said manifolds is of a diameter substantially smaller than the horizontal extent of said combustion chamber.

Preferably said tubes are vertically displaced relative each other at their connections to the manifolds.

In an advantageous construction each of said tubes has an approximately vertical portion and an inwardly-extending portion, the latter having an end connected to a respective one of said manifolds and the approximately vertical portion having an end connected to a respective cylinder or regenerator top, and the inwardly-extending portions being inclined relative to one another so that gaps for the passage of combustion gases between the inwardly-extending portions are of substantially constant effective width and resistance to the flow of the said combustion gases.

THE DRAWING

Figure 2:
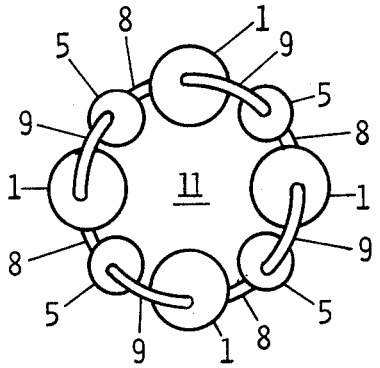
Figure 3:
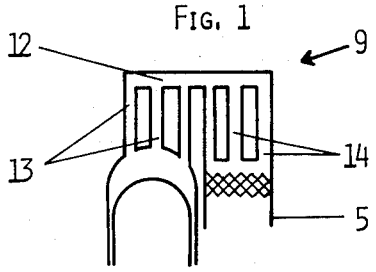
Figure 5:
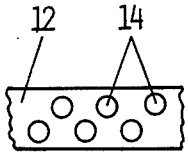
Figure 4:
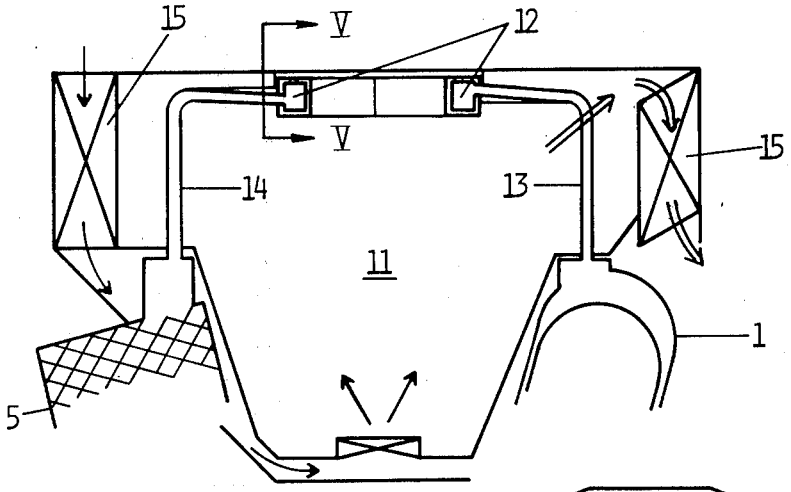
Figure 6:
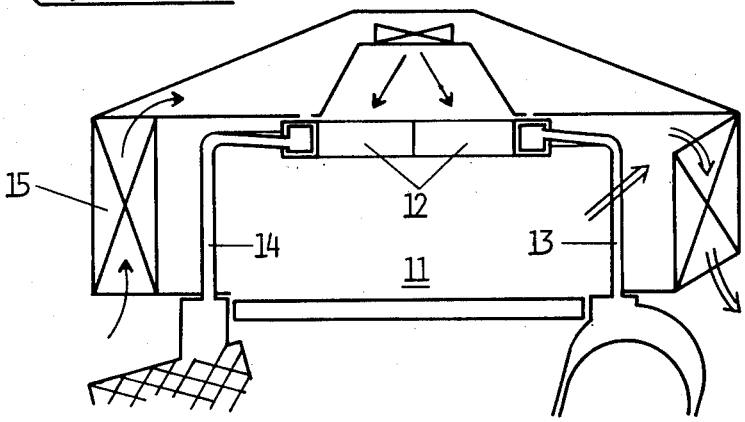

How the invention may be put into practice is described in more detail with reference to the accompanying drawings, in which FIG. 1 schematically shows parts of a double-acting hot gas engine, FIG. 2 schematically shows the connections between the cylinders and the regenerators of a four-cylinder hot gas engine, FIG. 3 shows schematically a part of a heater head of conventional design, FIG. 4 shows diagrammatically a vertical section through a heater head according to the invention in combination with a first combustion chamber, FIG. 5 shows a detail view of a part of FIG. 4 in the direction of the arrows V—V of FIG. 4, and FIG. 6 shows diagrammatically a vertical section of the last-mentioned heater head according to the invention arranged in combination with a second combustion chamber.

FIG. 1 represents a cylinder 1 in which reciprocates a piston 2 dividing the interior of the cylinder 1 into an upper variable-volume space 3 and a lower variable-volume space 4. A unit 5 containing a regenerator 6 and a cooler 7 is connected to the space 4 via a duct 8, and to the upper variable-volume space of an adjacent cylinder (not shown) via a connection 9. The piston 2 is provided with a piston rod 10 connected to a drive mechanism (not shown).

As shown schematically in FIG. 2, a hot gas engine viewed from above may comprise four cylinders 1, four regenerator-cooler units 5, four ducts 8 and four connections 9, all elements being arranged around a central vertical axis of a single combustion chamber 11. The connections 9 may be formed by heat exchanger tubes.

FIG. 3 shows how the connections 9 may comprise a horizontally extending manifold 12 connected to the top of the cylinder 1 by vertically extending tubes 13, the manifold also being connected to the regenerator - cooler unit 5 by vertically extending tubes 14. In some known types of heater heads consisting of seqments of the type shown in FIG. 3 the manifolds 12 together form a ring of a diameter corresponding to or greater than the diameter of the combuston chamber 11.

During the operation of an engine such as that schematically illustrated in FIGS. 1, 2 and 3 a working gas charge is heated in each of the four connections 9, allowed to expand in the variable-volume space 3, displaced through the regenerator 6 and cooler 5, and compressed in the variable-volume space 4.

In order to obtain a good efficiency of such an engine, the non-variable volume spaces, i.e. the spaces within the regenerator - cooler units 5, the ducts 8 and the connections 9, should be as small as possible. However, the heat-absorbing surfaces of each connection 9 should be sufficient to exchange heat adequately between the working gas inside the connection 9 and the hot combustion gases flowing around said connection 9 at the outside thereof. The manifold 12 should be sufficiently wide to allow flow of gas therein without an unacceptable pressure loss.

FIG. 4 shows a heater head comprising heat exchanger tubes 13 and 14 connected to respective manifolds 12 and respective cylinder tops and regenerator tops. The manifolds 12 together form a ring, and it can be seen how the volumes of the spaces within the manifolds 12 have been decreased as compared with the conventional manifolds.

As shown in FIGS. 4 and 6 the tubes 13 and 14 extend upwardly relative to the cylinders and regenerators, and in addition are bent to extend inwardly towards a vertical central axis of the combustion chamber 11. Thus the manifold segments 12 will form a ring of comparatively small diameter (about 50% of the size in the prior art constructions of FIGS. 1, 2 and 3) and thus the volumes of the spaces within the manifolds 12 are decreased correspondingly. The ratio of the mean diameter of the ring of manifolds 12 to the internal diameter of the combustion chamber 11 is about 1:3 in FIG. 3 and about 4:9 in FIG. 4; it is advantageous if the mean diameter of the said ring is not greater than one half of the internal diameter of the combustion chamber.

In order to maintain a substantially constant effective width of each gap between the tubes 13 and 14, and thus a substantially constant flow resistance and pressure drop in the flow of combustion gases when passing between the tubes 13 and 14, the tube ends are vertically relatively displaced at their connections to the manifolds 12. This is shown more clearly in FIG. 5, and as FIGS. 4 and 6 show the inwardly-extending portions of the tubes 13 and 14 are inclined relative to one another.

As shown in FIG. 4, air for combustion as indicated by single line arrows is passed through a heat exchanger 15 where it is heated in counterflow by the combustion gases about to leave the engine. The air is burnt with fuel in the combustion chamber 11, and the hot combustion gases as indicated by double line arrows are passed between the tubes 13 and 14 and subsequently passed through the heat exchanger 15. FIG. 6 shows how the combustion chamber may be arranged so that the hot combustion gases initially pass through the opening formed by the ring of manifolds.

What I claim is:

1. A hot gas engine heater head comprising in combination, a set of cylinders and regenerators positioned about an axis, a combustion chamber surrounding said axis with a predetermined internal diameter, heat exchange tubes connecting said cylinders and regenerators extending upwardly into said combustion chamber and inwardly toward said axis, and a set of manifold segments coupling together the respective heat exchange tubes connecting said cylinders and regenerators forming a ring about said axis of a diameter substantially smaller than that of said combustion chamber.

2. A heater head according to claim 1, wherein the mean diameter of the manifold ring is not greater than one half of the internal diameter of the combustion chamber.

3. A heater head as defined in claim 1, wherein said manifold segments are joined to said heat exchange tubes at a plurality of at least two vertically displaced positions.

4. A heater head according to claim 3, wherein each of said heat exchange tubes has an approximately vertical portion and an inwardly-extending portion, the latter having an end connected to a respective one of said manifold segments and the approximately vertical portion having an end connected to a respective cylinder or regenerator top, and the inwardly-extending portions being inclined relative to one another so that gaps for the passage of combustion gases between the inwardly-extending portions are of substantially constant effective width and resistance to the flow of the said combustion gases.

* * * * *